United States Patent [19]

Murphy, Jr. et al.

[11] 4,038,507

[45] July 26, 1977

[54] OIL LEVEL REGULATOR AND SHUT-DOWN DEVICE FOR STATIONARY ENGINES AND COMPRESSORS

[75] Inventors: Frank W. Murphy, Jr.; Buddy G. Sparks, both of Tulsa; Lewis M. Carlton, Jenks, all of Okla.

[73] Assignee: Frank W. Murphy Manufacturer, Inc., Tulsa, Okla.

[21] Appl. No.: 659,846

[22] Filed: Feb. 20, 1976

[51] Int. Cl.[2] ..... H01H 35/18

[52] U.S. Cl. ..... 200/84 R; 137/448; 73/317; 340/244 B; 200/308

[58] Field of Search ..... 73/308, 317; 200/302, 200/308, 61.2, 84 R; 137/434, 448, 399, 400; 340/244 B; 116/118 R

[56] References Cited

U.S. PATENT DOCUMENTS

| | | | |
|---|---|---|---|
| 2,907,845 | 10/1959 | Culley | 200/84 R |
| 3,012,437 | 12/1961 | Clark et al. | 73/317 |
| 3,138,024 | 6/1964 | Pariser et al. | 73/308 |
| 3,405,687 | 10/1968 | Ruter | 137/448 |
| 3,686,451 | 8/1972 | Pottharst, Jr. | 200/84 R |

*Primary Examiner*—Gerald P. Tolin
*Attorney, Agent, or Firm*—D. Paul Weaver

[57] ABSTRACT

A combination monitoring and regulating instrument for oil field stationary engines or compressors receives oil by gravity in a float chamber having a float operated oil admission and shut-off valve and particle filtering means. Oil from the float chamber is delivered by gravity feed to the crankcase of the associated stationary machine. When the external oil supply is depleted, the resulting movement of the float in the float chamber will produce rotation of a sealed shaft which extends into an explosion-proof chamber of the instrument to move a float position pointer therein, and to simultaneously activate an ignition cut-off switch, or equivalent pneumatic valve means in the explosion-proof chamber to shut down the stationary machine. A convenient oil level sight gage is provided on the instrument.

12 Claims, 7 Drawing Figures

OIL LEVEL REGULATOR AND SHUT-DOWN DEVICE FOR STATIONARY ENGINES AND COMPRESSORS

BACKGROUND OF THE INVENTION

Recent stringent Government regulations pertaining to safety and health in industry (OSHA) create an urgent need for complying equipment and instrumentation in many areas. In connection with stationary oil field equipment, such as engines and compressors, there is a requirement for a combined device to automatically maintain the proper crankcase oil level and to automatically shut down the engine or compressor following depletion of the usual gravity supply of oil below safe limits. In providing the automatic machine shut-down feature in compliance with existing regulations pertaining to hazardous locations, an explosion-proof chamber must be provided for all electrical contact or switching means.

It is the objective of the invention, therefore, to provide a combination-type instrument for the above purposes which will be in full compliance with all private and Government safety regulations and, in particular, OSHA regulations pertaining to oil field equipment.

It is a further object of the invention to provide an instrument of the mentioned type having additional novel features including the provision of a float position monitoring pointer within the explosion-proof chamber and behind a safety glass panel for that chamber. Additionally, the invention provides a convenient external sight gage allowing the level of oil in the float chamber to be directly observed, the sight gage reading being indicative of the oil level in the crackcase of the machine to which the invention is applied.

Another important feature of the invention is the provision of a sealed rotary shaft between the oil filled float chamber of the instrument and the explosion-proof chamber in which the pointer and associated ignition cut-off switch or equivalent pneumatic valve means is arranged.

The instrument which includes all of these features possesses compactness, sturdiness, ease of assembly and disassembly, and relative low cost of manufacturing.

The prior patented art contains certain teachings relative to automatic devices for maintaining lubricating oil levels in engines and the like and for shutting down such machines when the oil level is below safe limits. Examples of the patented prior art are U.S. Pat. Nos. 1,280,222 and 2,903,091. These patented devices do not have the ability to comply with existing safety regulations and do not possess explosion-proof chambers for their electrical contacts or switching means and neither do they possess the combined capabilities of the present invention for performing a number of monitoring and control functions at one time. Thus, the present invention is deemed to be a distinct improvement on the known prior art and such improvement or advancement in the art constitutes a further objective of the invention.

Other features and advantages of the invention will become apparent during the course of the following description.

BRIEF DESCRIPTION OF DRAWING FIGURES

DETAILED DESCRIPTION

Figure 1:
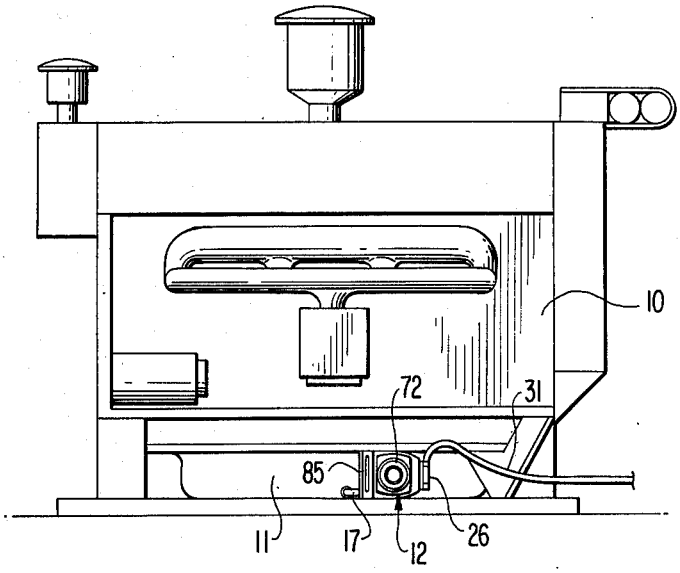
FIG. 1 is a side elevational view of the invention applied to a stationary engine or compressor.
Figure 5:
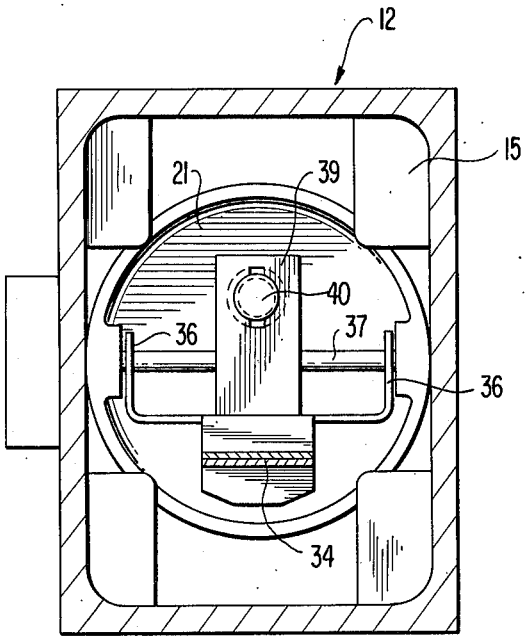
FIG. 5 is a vertical section taken on line 5—5 of FIG. 4.

Referring to the drawings in detail wherein like numerals designate like parts, there is shown in FIG. 1 a stationary engine or compressor 10 of the type employed in oil fields and having a crankcase 11 which must be maintained with an adequate supply of lubricating oil. The device or instrument for automatically regulating the supply of oil to the crankcase 11 and for shutting down the machine 10 in the event of the diminished oil supply or inadequate crankcase oil level constitutes the subject matter of the invention and is shown in its entirety at 12 in FIG. 1.

The device or instrument 12 comprises a sturdy cast housing 13 having mounting bosses 14 on its rear side to facilitate attachment of the device as a unit to one side wall of the crankcase 11. The interior of the housing 12 defines a float chamber 15 which receives lubricating oil from a gravity supply as will be further described and delivers oil by gravity flow through an outlet 16 and through a suitable fitting 17 coupled with said outlet, FIG. 1, to the crankcase 11. The opening 18, FIG. 3. is merely a convenience port which may be normally plugged.

One end of the housing 12 has a relatively large machined opening 19 which receives snugly a short sleeve element 20 having an intermediate wall 21 provided with a threaded opening 22 for a threaded tubular nipple 23 through which oil passes in entering the float chamber 15. A particle filtering screen 24 is arranged immediately outwardly of the nipple 23 and is clamped tightly against an annular extension 25 of the sleeve 20 by a cap element 26 having a flange 27, FIG. 2, secured by screws 28 to the adjacent end face of the housing 12. An O-ring type seal 29 is carried by an annular groove in the sleeve element 20 and serves to seal the cap 26 with respect to the sleeve element 20 and the sleeve element relative to the bore or opening 19 of the housing.

Figure 3:
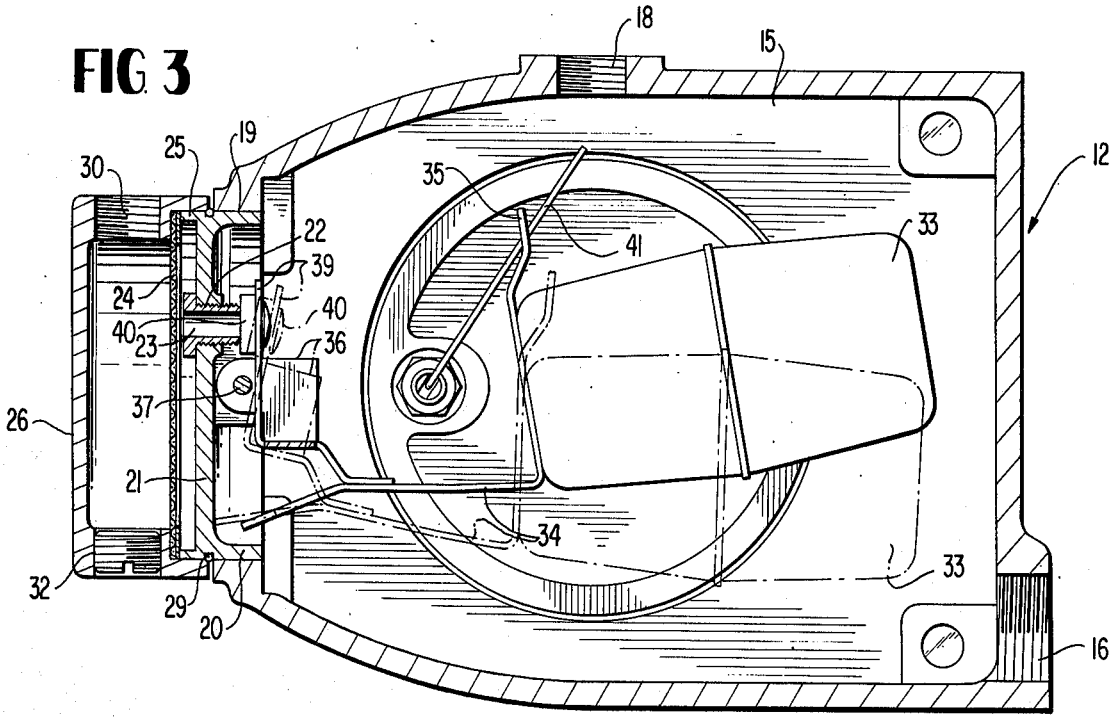
FIG. 3 is a vertical cross sectional view through the invention.

The cap 26 has an upper oil supply opening 30 which receives lubricating oil by gravity through a line 31 leading to an elevated oil drum or the like, not shown. The opening 30 receives a suitable fitting associated with the supply line or hose 31. A plugged convenience opening 32, FIG. 3, is proveded in the cap 26 opposite the opening 30.

A float element 33 is disposed within the chamber 15 and is supported therein by a float arm 34 having an upward slotted extension 35, for a purposes to be described. The float arm 34 has side apertured extensions 36 which are mounted rotatably on a cross shaft 37 held within openings 38 of sleeve element 20. A substantially right angular upstanding extension 39 of the float arm 34 at its end remote from the float 33 and midway between the side extensions 36 carries a preferably neoprene disc or thumb valve element 40 adapted to abut and seal the opposing end of the fitting 23, or nipple, when the float 33 is in a raised position as shown in full lines in FIG. 3. This action shuts off the entry of oil into the chamber 15 at proper times, thus regulating the entry of oil to the crankcase 11. When the float 33 is lowered, as shown in broken lines in FIG. 3, the valve element 40 moves away from the nipple 23 and opens the bore thereof to admit oil to the chamber 15 and crankcase 11 by gravity flow. The interior end of the fitting 23 forms a seat for the neoprene valve element 40.

The slotted float arm extension 35 slidably engages a crank arm 41 of a rocker shaft 42 within the float chamber 15. The rocker shaft 42 is journaled for rotation in a slender sleeve 43 held against rotation in the bore 44 of a threaded adapter 45 by a nut 46. The nut 46 compresses an O-ring seal 47 into fluid sealing engagement with the adapter 45 and sleeve 43. A bearing sleeve or shaft guide 48 soldered or otherwise secured to the adapter 45 at 49 contains a second O-ring seal 50 to seal the rotary shaft 42 relative to elements 45 and 48. A rotary stabilizing bearing 51 for the shaft 42 turns therewith and has a slot 52 receiving the crank arm 41.

Figure 2:
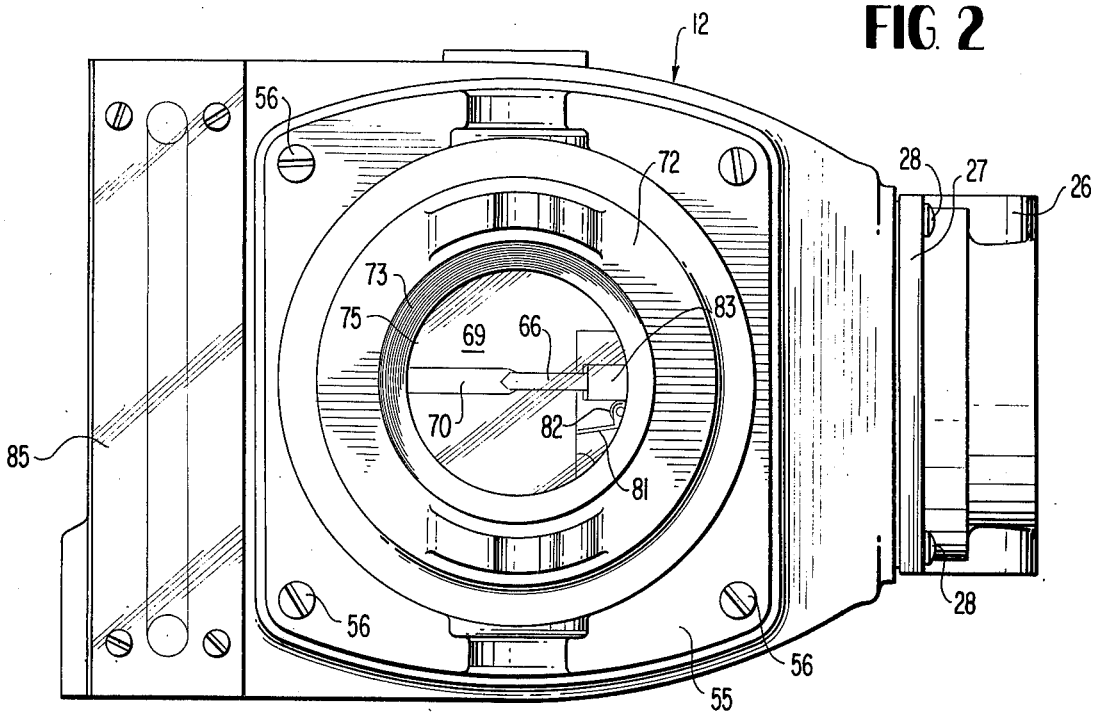
FIG. 2 is an enlarged side elevation of the invention unit.

An explosion-proof chamber 53 entirely isolated and sealed from the float chamber 15 is defined by a separate cast cylindrical casing 54 having a mounting flange 55, FIG. 2, secured by screws 56 to the opposing front wall 57 of the housing 12. The casing 54 has an inner end wall 58 separating the chambers 15 and 53 and an annular extension 59 of the casing 54 is received in an opening 60 of the housing wall 57. The housing wall 57 and its opening 60 are effectively sealed relative to the separate casing 54 by an O-ring seal 61, as shown.

Figure 7:
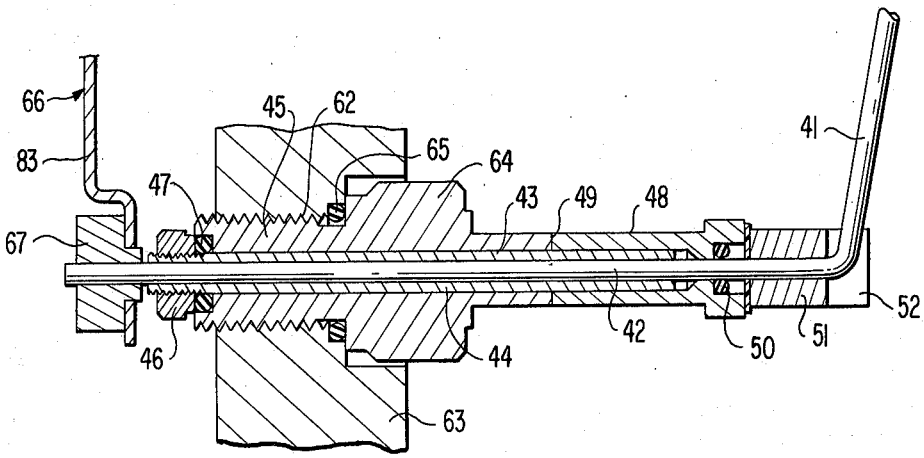
FIG. 7 is an enlarged fragmentary vertical section taken on line 7—7 of FIG. 4.

The adapter 45 is received by a threaded opening 62, FIG. 7, formed in a boss 63 of casing 54 and the adapter head 64 is sealed by an O-ring seal 65 relative to the casing 54. By virtue of the described arrangement, the two chambers 15 and 53 are sealed and isolated even though the rotatable shaft 42 extends between them and into the explosion-proof chamber 53.

Within the explosion-proof chamber 53 the projecting end of shaft 42 carries a pointer 66 secured to the shaft adjustably through a bearing element 67 having a shaft engaging set screw 68. The pointer moves with the shaft 42 in relation to a stationary dial or plate 69 having an indicator mark 70 thereon indicative of a normal oil level in the crankcase 11 and instrument housing 15. Positions of the float 33 above or below the optimum oil level are reflected by deviation of the pointer 66 from the indicator mark 70 in either direction.

Figure 4:
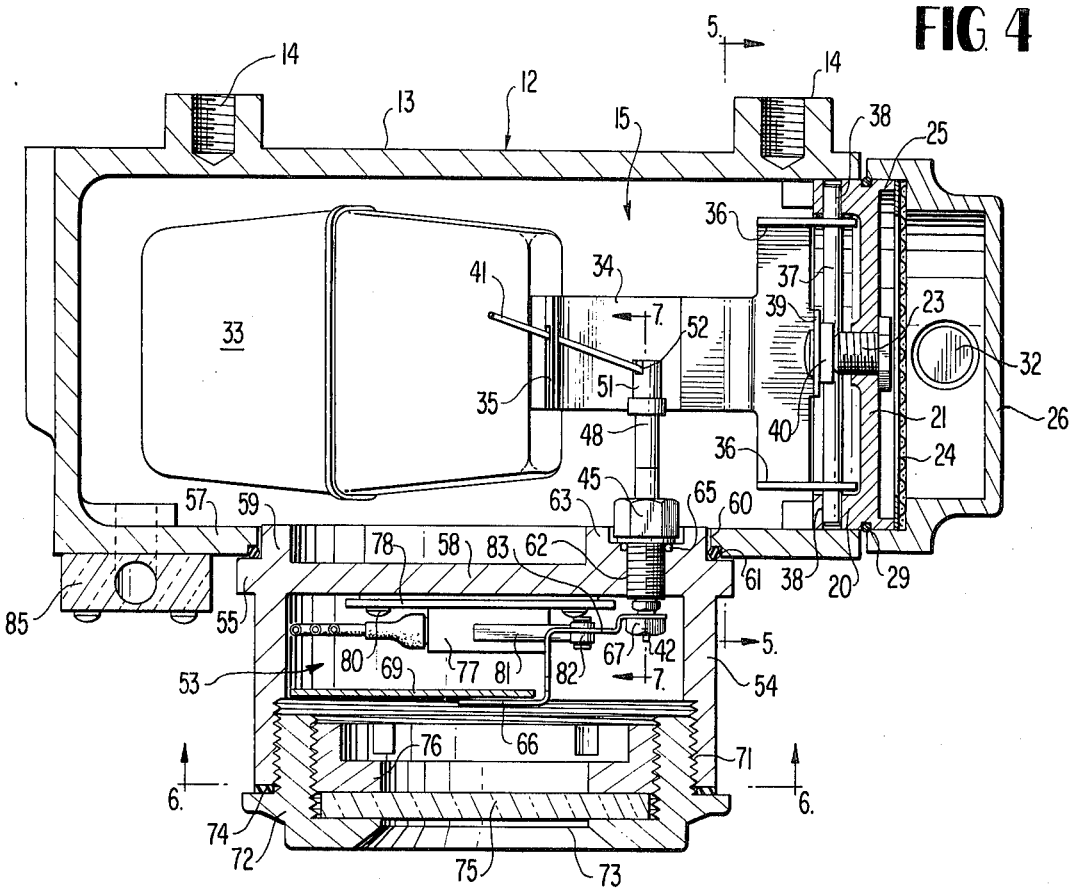
FIG. 4 is a horizontal cross sectional view through the invention as depicted in FIGS. 2 and 3.

Casing 54 has an outer internally threaded bore 71 receiving an internally and externally threaded cap 72 having a central large opening 73 or window. A flange of the cap 72 engages and compresses a sealing gasket 74, as shown in FIG. 4. A transparent safety glass plate 75 is held firmly in contact with the cap by an internal nut 76 and the glass plate is sealed relative to the cap 72 in a customary manner. Consequently, the explosion-proof chamber 53 is completely closed and sealed from the surrounding atmosphere.

Figure 6:
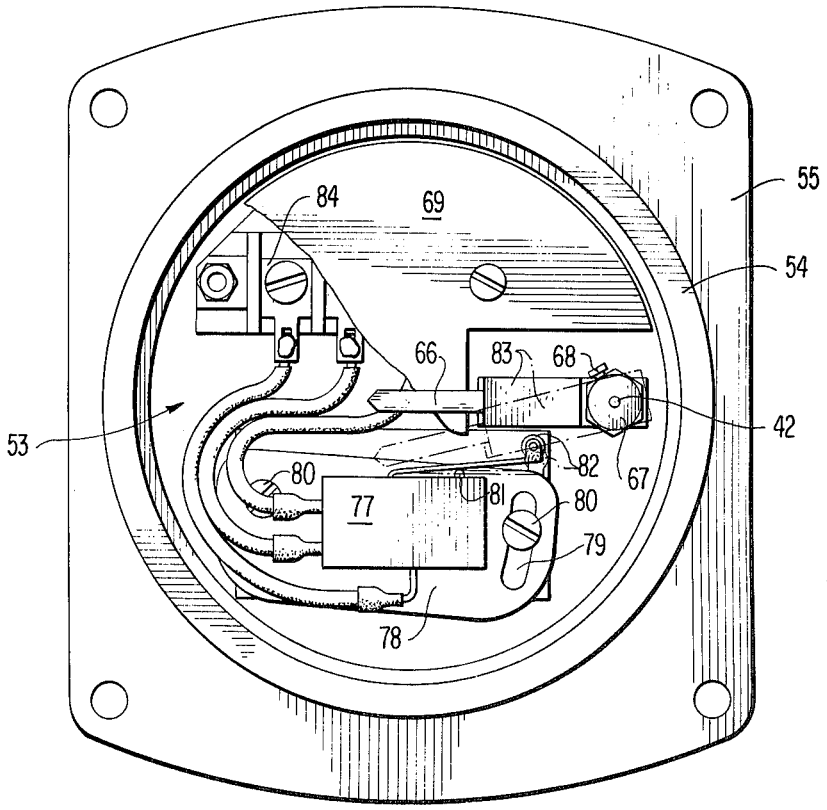
FIG. 6 is an enlarged fragmentary elevational view with parts removed and parts broken away taken on line 6—6 of FIG. 4.

A microswitch 77 or the like is disposed in the explosion-proof chamber 53 and is carried by a mounting plate 78 having an adjusting slot 79. The plate 78 is adjuatably secured to the casing wall 58 by screws 80, FIG. 6. The switch 77 has an actuator arm 81 carrying a roller 82 adapted to be engaged by an offset section 83 of the pointer 66. The switch is wired through a junction strip 84 within the explosion-proof chamber 53 as shown in FIG. 6. The switch 77 is electrically connected with the ignition circuit of the engine or compressor 10 to automatically shut down the latter and prevent damage of the same when the oil level in the crankcase 11 and float chamber 15 drops below safe limits as sensed by the float 33. When the float is thus lowered in the chamber 15, its arm extension 35 turns the crank arm 41 and sealed shaft 42 with pointer 66 in the proper direction for causing pointer portion 83 to engage and depress switch actuator roller 82 whereby the switch will open the ignition circuit of the machine 10.

In some cases, an equivalent pneumatic type switch or valve device may be placed in the chamber 53 instead of the switch 77 and may be operated in a similar manner by the pointer. Such pneumatic control devices are well known in the art. When employed, a suitable venting means for the pneumatic device would be provided.

When the float 33 descends in the chamber 15 responsive to an inadequate oil level therein, the valve element 40 moves away from the inlet nipple 23, thus admitting more oil to the chamber 15 and crankcase 11 to re-establish the proper oil level. The resulting elevation of the float 33 will cause reseating of valve element 40 against the end of nipple 23 to shut off the inflow of oil from the external source.

Thus it may be seen that the invention continuously monitors the level of oil in the engine or compressor crankcase by means of the pointer 66 and associated indicator marking, and automatically maintains the crankcase full or at a proper level by continuous operation of the float controlled valve means 40—23. Should the external supply of oil be completely depleted, the resulting abrupt lowering of the float 33 and turning of the shaft 42 and pointer 66 will cause activation of the cut-off switch 77, as described, for cutting off or shutting down the engine or compressor. Since the switch 77 is contained in an explosion-proof chamber, there is no danger of a spark producing an explosion and thus the operation is entirely safe. The pointer portion 83 will not move sufficiently far to actuate switch 77 unless the oil level is dangerously low or the supply depleted. In other cases, the movement of the float 33 will be only sufficient to operate the valve 40 and maintain the oil level in safe limits without activating the shut-down switch.

An additional feature of the invention is the provision of a convenient oil level sight gage 85 on the front of the front of the housing 12 whereby personnel can immediately observe the crankcase oil level.

It is to be understood that the form of the invention herewith shown and described is to be taken as a preferred example of the same, and that various changes in the shape, size and arrangement of parts may be resorted to without departing from the spirit of the invention or scope of the subjoined claims.

I claim:

1. An oil level regulating and safety shut-down device for engines and the like comprising a housing means having a float chamber provided with oil inlet and oil outlet passage means and an explosion-proof chamber isolated from the float chamber, float valve means on the housing means in the float chamber for automatically opening and closing said oil inlet passage means to maintain an optimum level of oil in the float chamber, a sealed rotary shaft extending between the float chamber and explosion-proof chamber and operatively engaged with the float valve means whereby rising and falling of the latter causes turning of said rotary shaft, an indicator means on said rotary shaft in the explosion-proof chamber, and an engine shut-down control means in the explosion-proof chamber including a movable actuator in the path of movement of said indicator means, said float valve means comprising a float and float supporting arm pivotally mounted in said float chamber, a valve element bodily carried by said float supporting arm and swingable therwith into opening and closing engagement with said oil inlet passage means, and a crank arm on said sealed rotary shaft in the float chamber and having a lost motion connection with said float supporting arm.

2. An oil level regulating and shut-down device as defined by claim 1, wherein said oil inlet passage means includes a stationary oil inlet tubular nipple communicating with said float chamber and having an outlet end in the path of movement of the swingable valve element.

3. An oil level regulating and shut-down device as defined by claim 3, and said valve element comprising a rubber-like valve disc on said float supporting arm.

4. An oil level regulating and shut-down device as defined by claim 1, and said engine shut-down control means comprising an electrical control switch in the explosion-proof chamber adapted for coupling into the ignition circuit of an engine or the like.

5. An oil level regulating and shut-down device as defined by claim 4, and said indicator means on said rotary shaft comprising a pointer having a portion thereof adapted to engage said movable actuator of said swtich during turning of the rotary shaft in one direction.

6. An oil level regulating and shut-down device as defined by claim 5, and said explosion-proof chamber having a transparent window means to allow viewing of said pointer.

7. An oil level regulating and shut-down device as defined by claim 1, and said housing means comprising a first housing section defining said float chamber, and a second housing section defining said isolated explosion-proof chamber and being detachably coupled to the first housing section.

8. An oil level regulating and shut-down device as defined by claim 7, and a threaded adapter member for said sealed rotary shaft having threaded engagement within a wall of the second housing section forming said explosion-proof chamber and forming a bearing support for said rotary shaft.

9. An oil level regulating and shut-down device as defined by claim 8, and O-ring seal means for said rotary shaft on said adapter member.

10. An oil level regulating and shut-down device as defined by claim 2, and a particle filtering element removably secured to the housing means upstream from said tubular nipple in the oil inlet passage means.

11. An oil level regulating and shut-down device as defined by claim 10, and the oil inlet passage means comprising a cap member detachably secured to the housing means in clamping relationship to the particle filtering element.

12. An oil level monitoring, regulating and safety shut-down device for oil field stationary engines, compressors and the like comprising a housing means having a float chamber provided with oil inlet and oil outlet passage means and an explosion-proof chamber isolated from the float chamber, float valve means on the housing means within the float chamber for automatically opening and closing said oil inlet passage means to maintain an optimum level of oil in said float chamber, a sealed rotary shaft extending between the float chamber and explosion-proof chamber and operatively engaged with the float valve means within the float chamber whereby rising a falling of the float valve means causes turning of said rotary shaft, a visual indicator element on said rotary shaft in the explosion-proof chamber, and an engine shut-down control device in the explosion-proof chamber including a movable actuator in the path of movement of said visual indicator element, and said explosion-proof chamber having a viewing window adjacent said visual indicator element.

* * * * *